US005082152A

United States Patent [19]

Chen

[11] Patent Number: 5,082,152

[45] Date of Patent: Jan. 21, 1992

[54] GARMENT HANGER WITH ADJUSTABLE CLAMPING CROSSBAR

[76] Inventor: Shing-Huei Chen, c/o Hung Hsing Patent Service Center P. O. Box 55-1670, Taipei (10477), Taiwan

[21] Appl. No.: 634,075

[22] Filed: Dec. 26, 1990

[51] Int. Cl.[5] ..... A47A 25/48; A47A 25/14

[52] U.S. Cl. ..... 223/89; 223/90; 223/91; 223/96; 223/85; 211/117; D6/326; D6/327

[58] Field of Search ..... 223/96, 89, 94, 85, 223/88, 91; 211/117; D6/326, 327

[56] References Cited

U.S. PATENT DOCUMENTS

| | | | |
|---|---|---|---|
| 966,854 | 8/1910 | Peyton | 223/96 |
| 1,638,844 | 8/1927 | Gibson | 223/89 X |
| 2,300,797 | 11/1942 | McOsker | 223/96 |
| 2,494,711 | 1/1950 | Kusher et al. | 223/94 |
| 2,724,533 | 11/1955 | Hansen | 223/94 |
| 2,774,526 | 12/1956 | Reur | 223/89 |
| 3,760,995 | 9/1973 | Wheeler | 223/89 X |
| 4,830,237 | 5/1989 | Louw | 223/89 |

FOREIGN PATENT DOCUMENTS

| | | | |
|---|---|---|---|
| 1228075 | 3/1960 | France | 223/89 |

*Primary Examiner*—Werner H. Schroeder
*Assistant Examiner*—Bibhu Mohanty

[57] ABSTRACT

A hanger includes a pair of extendible shoulder members telescopically mounted on a pair of basic shoulders members bifurcated from a central hook of the hanger for adjustably hanging a suit, a dress, a jacket or the like by matching the width of the shoulder members of the hanger with the width of the clothes hung on the hanger for well maintaining the clothes, and a U-shaped cross bar laterally secured between the two basic shoulder members having a grading snap bar slidably engageable with two vertical brackets formed on two opposite end portions of the U-shaped cross bar for adjustably clamping at least a pair of trousers between the cross bar and the snap for preventing releasing of the trousers from the bars.

1 Claim, 4 Drawing Sheets

GARMENT HANGER WITH ADJUSTABLE CLAMPING CROSSBAR

BACKGROUND OF THE INVENTION

A conventional hanger includes two fixed shoulder bars protruding rightwardly and leftwardly from a central hanging hook for hanging a jacket, suit or dress thereon and further includes a cross bar horizontally secured between the two shoulder bars for hanging a pair of trousers or the like. However, since the two shoulder bars of the hanger are made as the fixed type having a fixed length for each bar, a jacket or a sweater of a big size when hung on a small hanger having shorter length of the two shoulder bars than a width of two opposite shoulder portions of the jacket or sweater for a long time, will become crumpled, wrinkled or lumped. If the cross bar of such a conventional hanger is used to hang a pair of trousers without being clamped thereon, the trousers may be easily slid away from the hanger.

The present inventor has found the drawbacks of a conventional hanger and invented the present adjustable hanger for multiple uses.

SUMMARY OF THE INVENTION

The object of the present invention is to provide a hanger including a pair of extendible shoulder members telescopically mounted on a pair of basic shoulder members bifurcated from a central hook of the hanger for adjustably hanging a suit, a dress, a jacket or the like by matching the width of the shoulder members of the hanger with the width of the clothes hung on the hanger for well maintaining the clothes, and a U-shaped cross bar laterally secured between the two basic shoulder members having a snap bar slidably engageable with two vertical brackets formed on two opposite end portions of the U-shaped cross bar for adjustably clamping at least a pair of trousers between the cross bar and the snap bar for preventing releasing of the trousers from the bars.

BRIEF DESCRIPTION OF THE DRAWINGS

FIG. 4 is a cross sectional drawing of the present invention when viewed from 4—4 direction of FIG. 3.

FIG. 5 is a cross sectional drawing of the present invention when viewed from 5—5 direction of FIG. 3.

FIG. 6 is a partial illustration showing the U-shaped bar engaged with the snap bar of the present invention.

FIG. 7 is a cross sectional drawing of FIG. 6.

DETAILED DESCRIPTION

Figure 1:
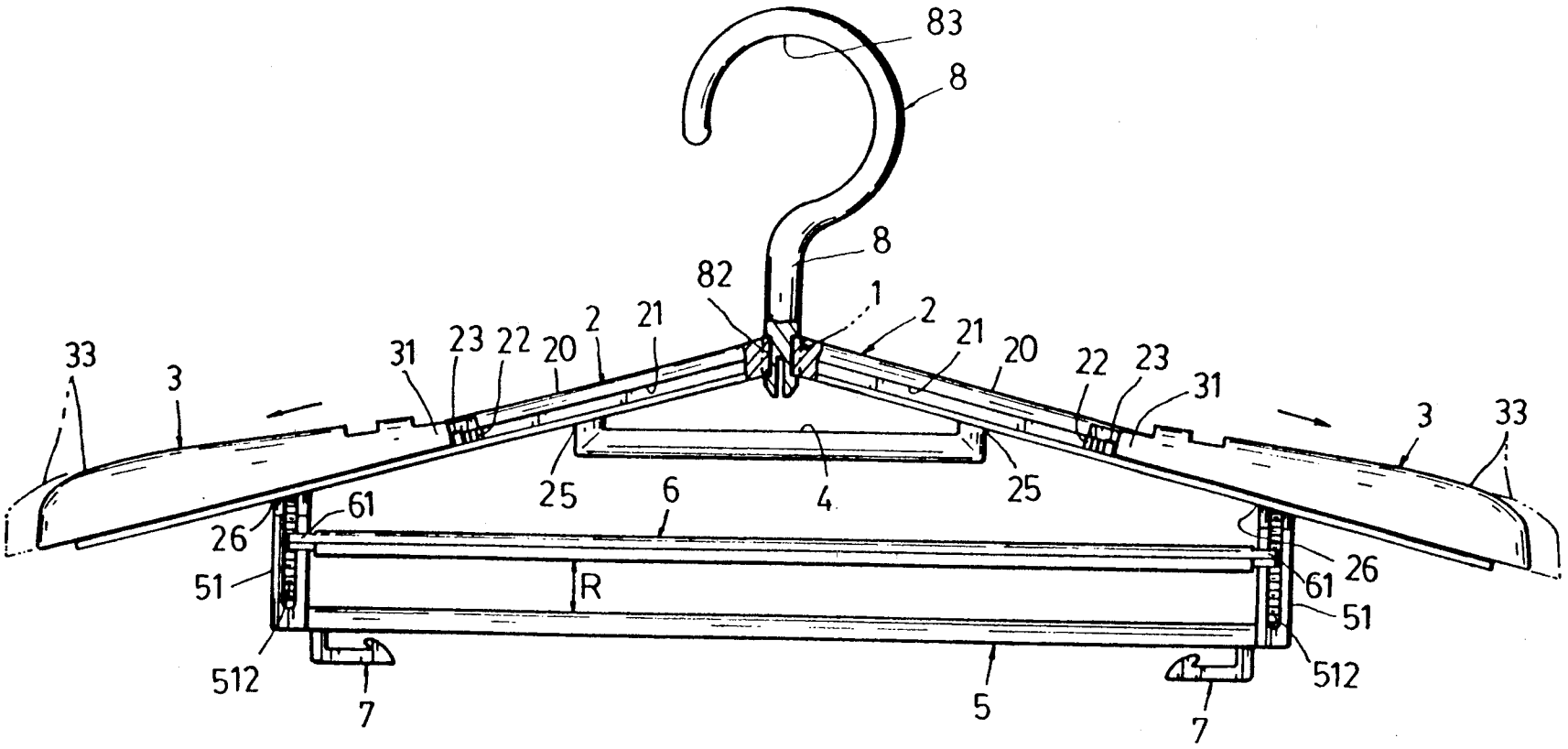
FIG. 1 is an illustration of the present invention.
Figure 3:
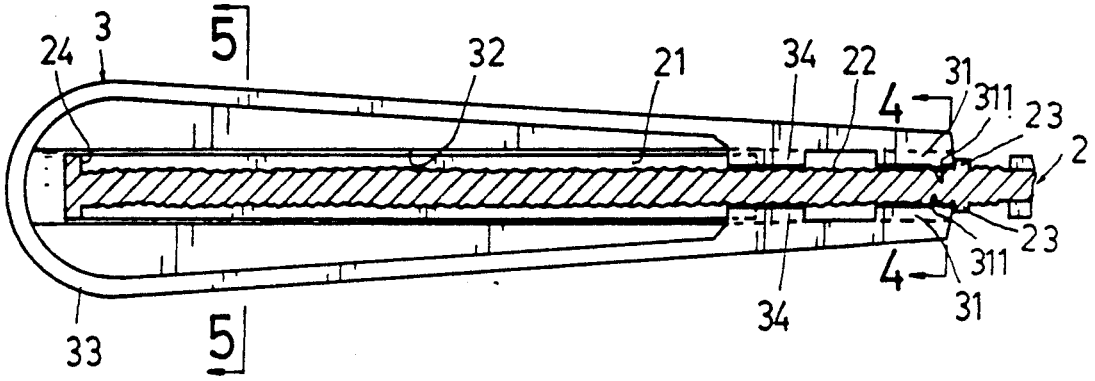
FIG. 3 is a bottom view of the shoulder members of FIG. 2.
Figure 2:
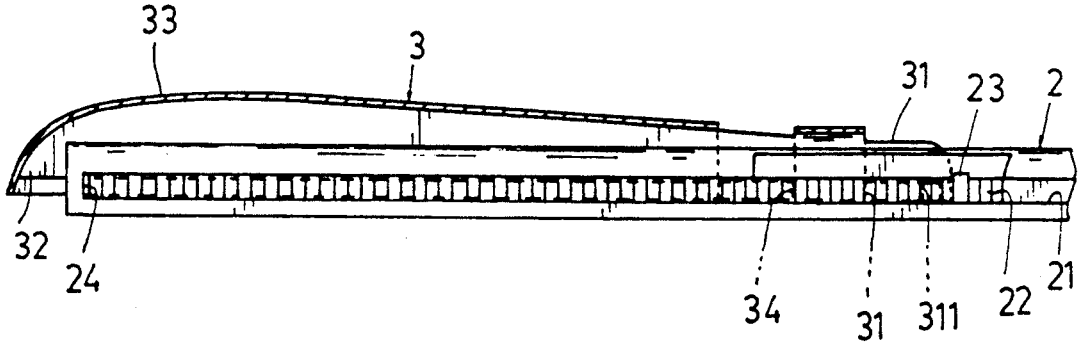
FIG. 2 is a partial cut-away illustration of the shoulder members of the present invention.

As shown in FIGS. 1-7, the present invention comprises: a central sleeve 1, two basic shoulder members 2 bifurcated from the central sleeve 1 protruding rightwardly and leftwardly from the sleeve 1, a pair of extendible shoulder members 3 respectively telescopically mounted on the two basic shoulder members 2, an auxiliary cross bar 4 laterally secured between two upper bottom portions 25 of the two basic shoulder members 2, a U-shaped cross bar 5 laterally secured between two lower bottom portions 26 of the two basic shoulder members 2, a rack and clamping teeth means having a snap bar 6 adjustably levelled on the U-shaped cross bar 5, a pair of bottom hook members 7 formed on two opposite bottom end portions of the cross bar 5, and a main hook member 8 pivotally mounted in the sleeve 1 for hanging the hanger on a wall or a fixture.

The main hook member 8 includes a shank portion having a shaft portion 82 pivotally secured with the central sleeve 1, and a hook portion 83 adapted to be hung on a fixture.

Each basic shoulder member 2 includes: an upper arcuate surface 20 formed on an upper surface of the shoulder member 2, a guide rail 21 having a cross section of generally I shape longitudinally formed on an outer portion of the shoulder member 2, a pair of racks 22 each rack 22 having a plurality of rack teeth longitudinally formed on two sides of the rail 21, an inner stopper 23 formed on an inner portion of the rack 22 and an outer stopper 24 formed on an outer end portion of the rack 22 for limiting a slide movement of the shoulder member 3 between the two stoppers 23, 24.

Figure 8:
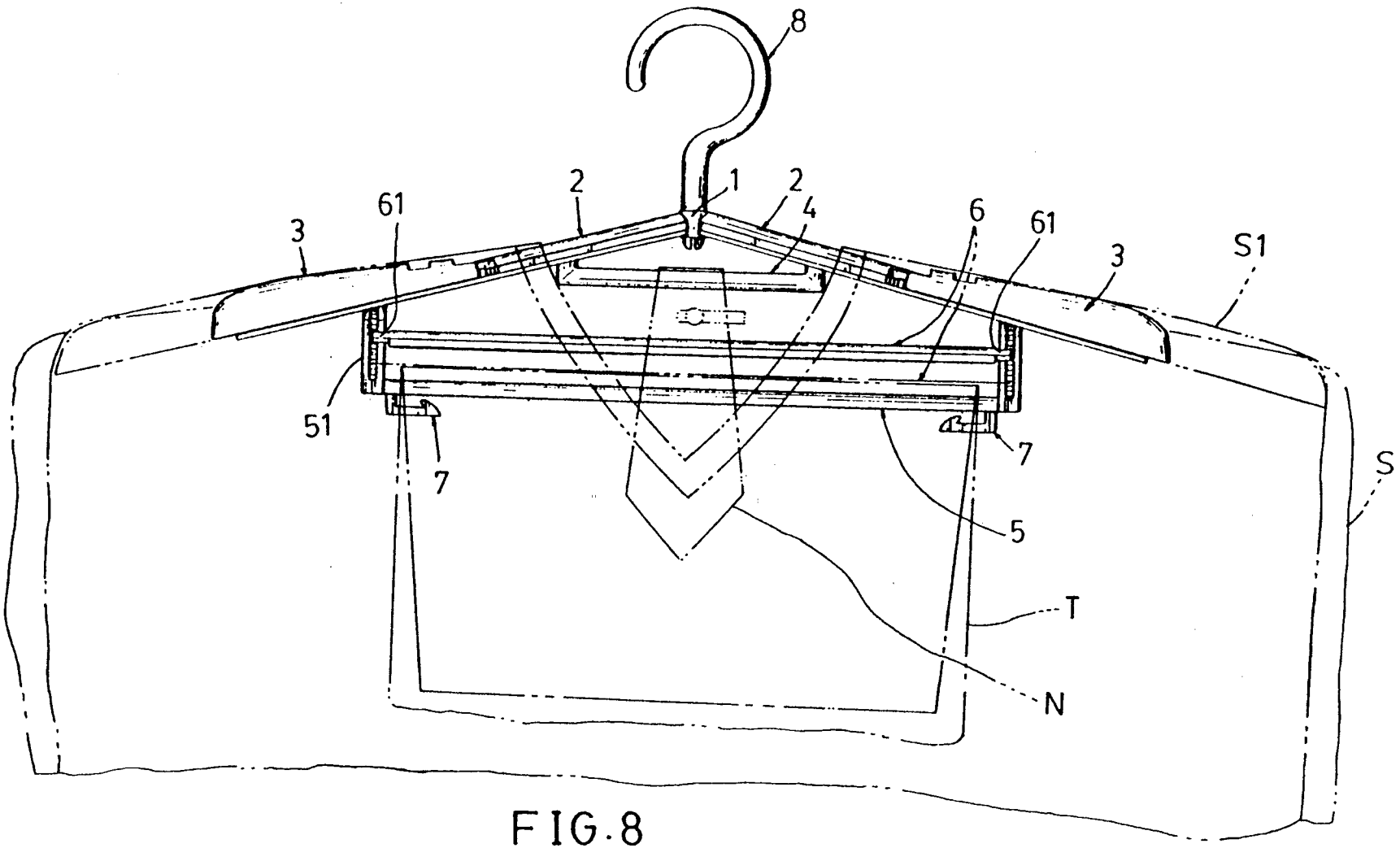
FIG. 8 is an illustration of the present invention when used for hanging a man's clothes.

Each extendible shoulder member 3 includes: an upper arcuate surface 30 on an upper portion of the member 3 slidably engageable with the arcuate surface 20 of member 2, a pair of shoulder clips 31 resiliently formed on an inner end portion of the member 3 slidably clamping the two racks 22 having a pair of upper clamping teeth 311 formed on two tip portions inside the two clips 31 engageable with two rack teeth disposed on two opposite sides of the rail 21, a longitudinal groove 32 longitudinally formed inside the extendible shoulder member 3 slidably engageable with the guide rail 21, a pair of sliding protrusions 34 formed inside the shoulder member 3 near the two clips 31 slidably engageable with the two racks 22 for stabilizing a sliding movement of the shoulder member 3 on the member 2, and an enlarged pad 33 formed on an outer end portion of the member 3 for supporting a clothing shoulder portion S1 of a sweater or suit S as shown in FIG. 8.

The U-shaped cross bar 5 includes two vertical brackets 51 formed on two opposite end portions of the bar 5 respectively secured to two lower bottom portions 26 of the two shoulder members, each vertical bracket 51 including a vertical groove 511 having a cross section of generally I shape, and a pair of vertical racks 512 respectively formed on two opposite sides of the groove 511.

The snap bar 6 includes a pair of bar clips 61 resiliently formed on two opposite ends of the bar 6 each clip 61 having a pair of lower clamping teeth 611 adjustably engageable with the rack teeth formed on the two racks 512 of the vertical brackets 51.

For hanging a suit S, a jacket or a coat C with wider shoulder portions of a man's or lady's clothings (FIGS. 8, 9), the two extendible shoulder members 3 can be extended outwardly to match with the width of the clothings for a proper hanging of the clothings for preventing their lumping or crumbling especially after a long-time hanging.

For hanging one or plural pairs of trousers T as shown in FIG. 8, the snap bar 6 may be adjusted for a suitable aperture A between the bar 5 and the bar 6 for snugly fastening the trousers therebetween to prevent their releasing or sliding away from the hanger.

Figure 9:
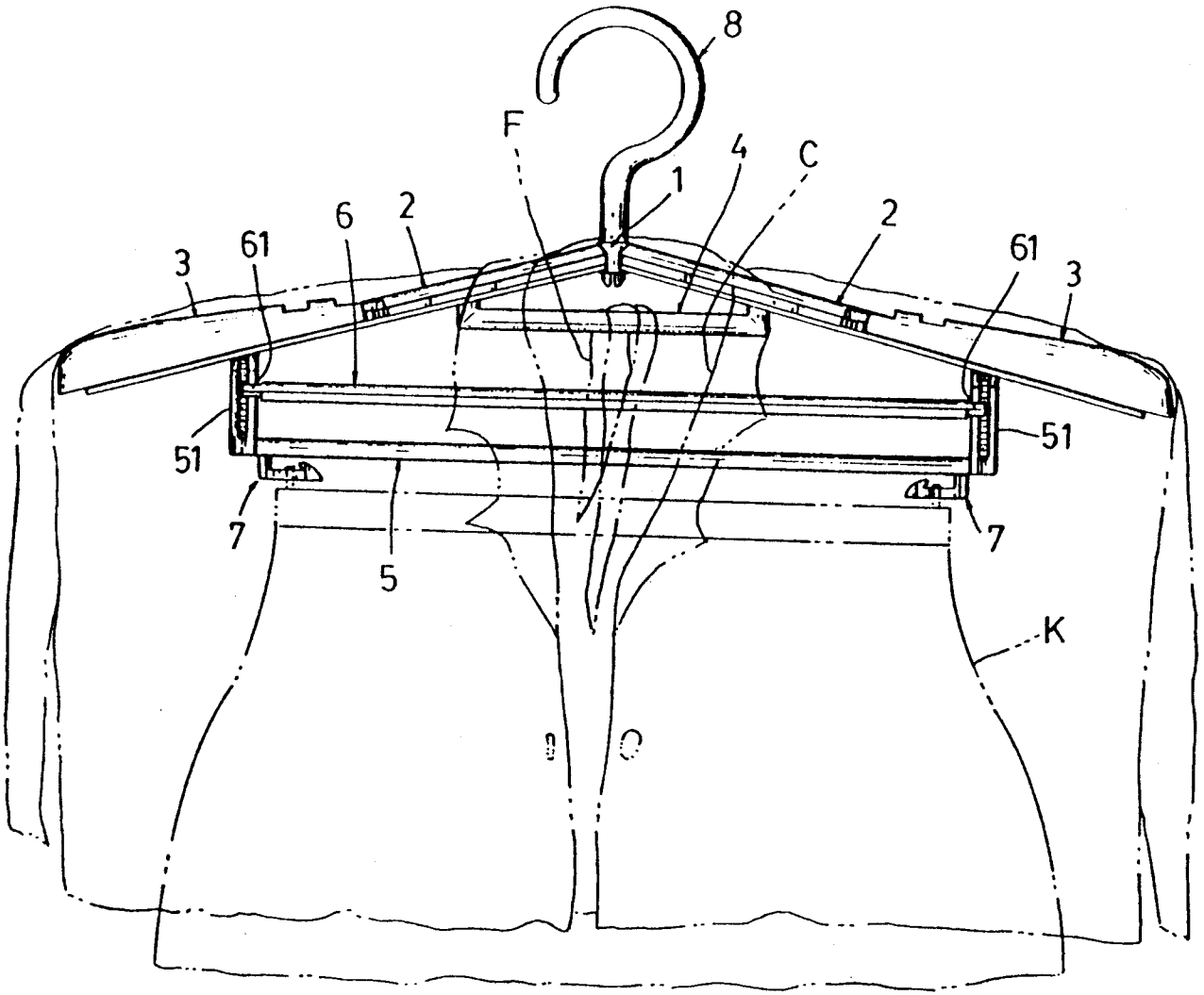
FIG. 9 shows the present invention for hanging a lady's clothing.

The bottom hook members 7 may be used to hang a lady's skirt K as shown in FIG. 9. The auxiliary cross bar 4 may be used to hang a necktie N (FIG. 8) or a scarf F (FIG. 9) on the bar 4.

Accordingly, this invention can serve a hanger for multiple hanging purposes. The telescopic sliding adjustment of the extendible shoulder member 3 on the basic shoulder member 2 can be variably smoothly adjusted and the clicking sound when sliding the teeth 311 with the rack teeth 22 or the sliding of teeth 611 with the rack teeth 512 may also give a sense of feeling which may spur a user's interest.

I claim:

1. An adjustable garment hanger comprising: a central sleeve, two basic shoulder members bifurcated from the central sleeve protruding rightwardly and leftwardly from the central sleeve, a pair of extendible shoulder members respectively mounted on the two basic shoulder members, a U-shaped cross bar laterally secured between said two basic shoulder members having two vertical brackets formed on two opposite end portions of said U-shaped cross bar and a adjustable snap bar supported between said vertical brackets by rack and teeth means which includes a pair of bar clips resiliently formed on opposite ends of the snap bar, each of said bar clips having a pair of lower clamping teeth adjustably engageable with a plurality of rack teeth formed on the two vertical brackets wherein said lower clamping teeth adjustably engage said rack teeth and the snap bar can be adjusted to a desired vertical position along the vertical brackets, said hanger further comprising a main hook member pivotally mounted in the central sleeve to be hung on a fixture.

* * * * *